US009554206B2

(12) United States Patent
Fujise et al.

(10) Patent No.: US 9,554,206 B2
(45) Date of Patent: Jan. 24, 2017

(54) SOUND PRESENTATION DEVICE

(71) Applicant: Panasonic Intellectual Property Management Co., Ltd., Osaka (JP)

(72) Inventors: Akiko Fujise, Osaka (JP); Toshiyuki Matsumura, Osaka (JP); Mitsuru Endo, Osaka (JP); Aki Yoneda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/809,308

(22) Filed: Jul. 27, 2015

(65) Prior Publication Data

US 2016/0066082 A1 Mar. 3, 2016

(30) Foreign Application Priority Data

Aug. 29, 2014 (JP) ..... 2014-176323

(51) Int. Cl.

| | |
|---|---|
| ***H04R 1/02*** | (2006.01) |
| ***H04R 1/28*** | (2006.01) |
| ***H04R 1/10*** | (2006.01) |
| *H04R 25/00* | (2006.01) |

(52) U.S. Cl.

CPC ..... *H04R 1/2888* (2013.01); *H04R 1/10* (2013.01); *H04R 1/1091* (2013.01); *H04R 1/28* (2013.01); *H04R 2460/13* (2013.01)

(58) Field of Classification Search

CPC ... H04R 25/606; H04R 2460/13; H04R 17/00; H04R 2225/021; H04R 17/005; H04R 1/1075; H04R 2400/03; H04R 1/10; H04R 1/1091; H04R 5/033; G02C 11/10

USPC ..... 381/151, 322, 324, 190, 381

See application file for complete search history.

(56) References Cited

U.S. PATENT DOCUMENTS

2013/0089229 A1* 4/2013 Kristo ..... H04R 25/606 381/326

FOREIGN PATENT DOCUMENTS

JP 2011-130334 6/2011

* cited by examiner

*Primary Examiner* — Sunita Joshi

(74) *Attorney, Agent, or Firm* — Greenblum & Bernstein, P.L.C.

(57) ABSTRACT

A sound presentation device including: a casing; an electroacoustic transducer that is installed in such a way that a space inside the casing is divided into a first empty chamber and second empty chamber that are acoustically isolated, and that receives an electrical signal and vibrates; and a vibration plate that makes contact with a body surface of a human body when the sound presentation device is mounted on the body surface, and causes vibration of the electroacoustic transducer to be propagated to the human body via the first empty chamber, the second empty chamber suppressing sound waves produced by the vibration of the electroacoustic transducer from being emitted to outside of the sound presentation device via the second empty chamber.

12 Claims, 7 Drawing Sheets

SOUND PRESENTATION DEVICE

BACKGROUND

1. Technical Field

The present disclosure relates to a sound presentation device.

2. Description of the Related Art

Bone conduction headphones are used as a way of being able to hear sound without covering the ears (for example, Japanese Unexamined Patent Application Publication No. 2011-130334).

SUMMARY

In one general aspect, the techniques disclosed here feature a sound presentation device including: a casing; an electroacoustic transducer that is installed in such a way that a space inside the casing is divided into a first empty chamber and second empty chamber that are acoustically isolated, and that receives an electrical signal and vibrates; and a vibration plate that makes contact with a body surface of a human body when the sound presentation device is mounted on the body surface, and causes vibration of the electroacoustic transducer to be propagated to the human body via the first empty chamber, the second empty chamber suppressing sound waves produced by the vibration of the electroacoustic transducer from being emitted to outside of the sound presentation device via the second empty chamber.

According to the sound presentation device of the present disclosure, it is possible to ensure the volume required to hear sound while also reducing user discomfort caused by a vibration element being pressed firmly against the head.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1A:
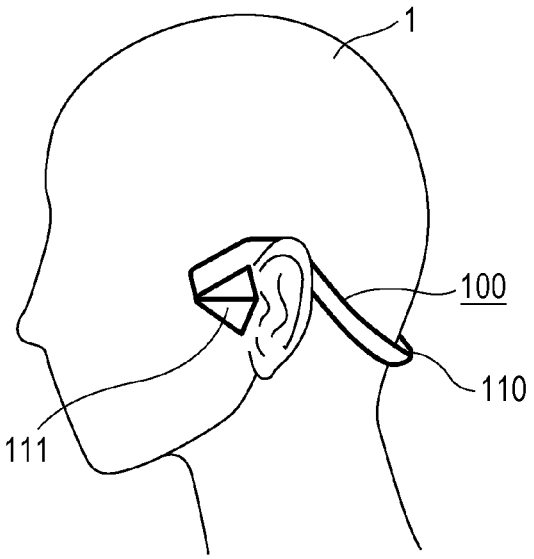
FIG. 1A is a drawing depicting an example of a state in which the sound presentation device in Embodiment 1 is worn.

Findings Forming the Basis of the Present Disclosure

In the bone conduction headphone device described in Japanese Unexamined Patent Application Publication No. 2011-130334, a bone conduction speaker is provided at an end section of a headband, and the bone conduction speaker presses against the side surface of the head in front of an ear of the user. The bone conduction speaker is further provided with a main vibration output unit that transmits sound to the user by bone conduction and an auxiliary vibration output unit that transmits sound to the user by cartilage conduction.

In the bone conduction headphones described in Japanese Unexamined Patent Application Publication No. 2011-130334, the transmission of vibration by bone conduction is achieved by the bone conduction speaker pressing against the side surface of the head due to the restoring force of the headband mounted on the head of the user. Therefore, pressure is constantly applied to the skin of the parts against which the bone conduction speaker presses, which results in discomfort for the user.

Furthermore, in the bone conduction headphones described in Japanese Unexamined Patent Application Publication No. 2011-130334, a driver mounted in the bone conduction speaker vibrates the side surface of the head of the user either directly or via a solid body, and therefore the position of the driver is in principle restricted to being on the axis of the transmission direction of the vibration, which results an increase in the thickness of the part that presses against the head of the user.

In other words, in the method described in Japanese Unexamined Patent Application Publication No. 2011-130334, it is necessary for a vibration element to be firmly pressed against the head in order to obtain a sufficient volume, and further examination has been necessary to make it possible for sound to be heard under conditions that are comfortable for the user.

The present disclosure provides a sound presentation device with which it is possible to hear sound at a sufficient volume without the ears being covered while also reducing discomfort.

A sound presentation device of the present disclosure is a sound presentation device including: a casing; an electroacoustic transducer that is installed in such a way that a space inside the casing is divided into a first empty chamber and second empty chamber that are acoustically isolated, and that receives an electrical signal and vibrates; and a vibration plate that makes contact with a body surface of a human body when the sound presentation device is mounted on the body surface, and causes vibration of the electroacoustic transducer to be propagated to the human body via the first empty chamber, the second empty chamber suppressing sound waves produced by the vibration of the electroacoustic transducer from being emitted to outside of the sound presentation device via the second empty chamber.

Furthermore, for example, the vibration plate may include at least a first vibration plate and a second vibration plate, the first empty chamber may include at least a first region and a second region, the casing may include at least a first casing that forms the first region and a second casing that forms the second region, the first vibration plate may be arranged in the first casing, and the second vibration plate may be arranged in the second casing.

Furthermore, for example, the first casing may include a hole, the second casing may include a cylindrical body that is a hollow cylinder, and the first region and the second region may be linked due to the cylindrical body being inserted into the hole.

Furthermore, for example, the second empty chamber may be hermetically sealed by the casing to thereby suppress the sound waves from being emitted to outside of the sound presentation device.

Furthermore, for example, a sound absorbing material may be arranged in part of the second empty chamber to thereby suppress the sound waves from being emitted to outside of the sound presentation device.

Furthermore, for example, a spacer that is disposed inside the casing and makes contact with both the vibration plate and a casing inner wall may be provided.

Furthermore, for example, the spacer may divide the first empty chamber into a plurality of regions, and the plurality of regions may be linked due to a hole being provided in part of the spacer.

Furthermore, for example, the flexural rigidity of a portion of the casing that covers the first empty chamber may be greater than the flexural rigidity of the vibration plate, and the vibration plate may have a bent shape.

Furthermore, for example, the casing that forms a wall surface of the second empty chamber may suppress the sound waves produced by the vibration of the electroacoustic transducer from being emitted to outside of the sound presentation device.

A sound presentation device according to an aspect of the present disclosure will be described in detail with reference to the drawings.

It should be noted that the embodiments described hereinafter all represent a specific example of the present disclosure. The numerical values, the shapes, the materials, the constituent elements, and the arrangement positions of the constituent elements and the like given in the following embodiments are examples and are not intended to restrict the present disclosure. Furthermore, from among the constituent elements in the following embodiments, constituent elements that are not described in the independent claim indicating the most significant concepts are described as optional constituent elements.

In other words, embodiments that are examples for realizing a sound presentation device according to an aspect of the present disclosure are described hereinafter; however, each embodiment is merely an example and is not restricted to the following description. Furthermore, all of the content described in the embodiments is able to be combined.

(Embodiment 1)

Hereinafter, a sound presentation device in Embodiment 1 will be described with reference to the drawings.

Figure 1B:
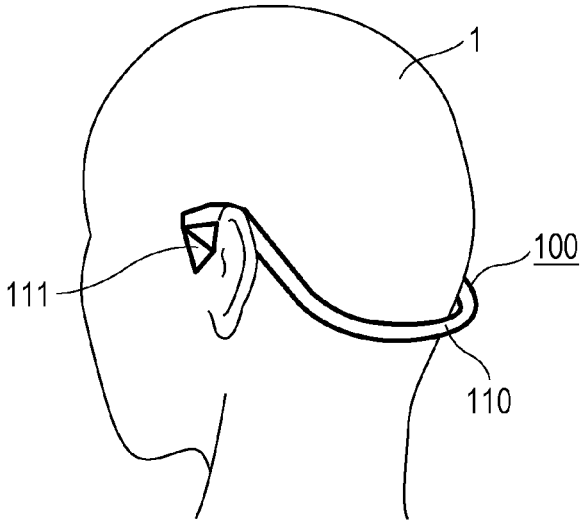
FIG. 1B is a drawing depicting an example of a state in which the sound presentation device in Embodiment 1 is worn.

FIGS. 1A and 1B are drawings depicting an example of a state in which a sound presentation device 100 in Embodiment 1 is worn. The sound presentation device 100 is mounted on the surface of a body (also referred to as a body surface) and used. In this regard, an example will be described in which the sound presentation device 100 is mounted on a head 1 of a person as the body surface and used, for example.

FIG. 1A is a drawing in which the head 1 of the person on which the sound presentation device 100 is mounted is viewed from the side, and FIG. 1B is a drawing in which the head 1 of the person on which the sound presentation device 100 is mounted is viewed from behind.

The sound presentation device 100 in the present embodiment is provided with an arm 110 and a sound transmission section 111. In Embodiment 1, the sound transmission section 111 of the sound presentation device 100 is disposed at an end section of the arm 110 and is arranged in such a way as to make contact in front of an ear. The arm 110 has an approximate U-shape that follows the back of the head, and holds the sound presentation device 100 in a prescribed position on the head 1 of the user. The rigidity of the arm 110 is selected within a range with which the sound transmission section 111 does not separate from the skin and the user is not aware of the force that is applied to the skin. It should be noted that the arm 110 is not an essential configuration.

Figure 2A:
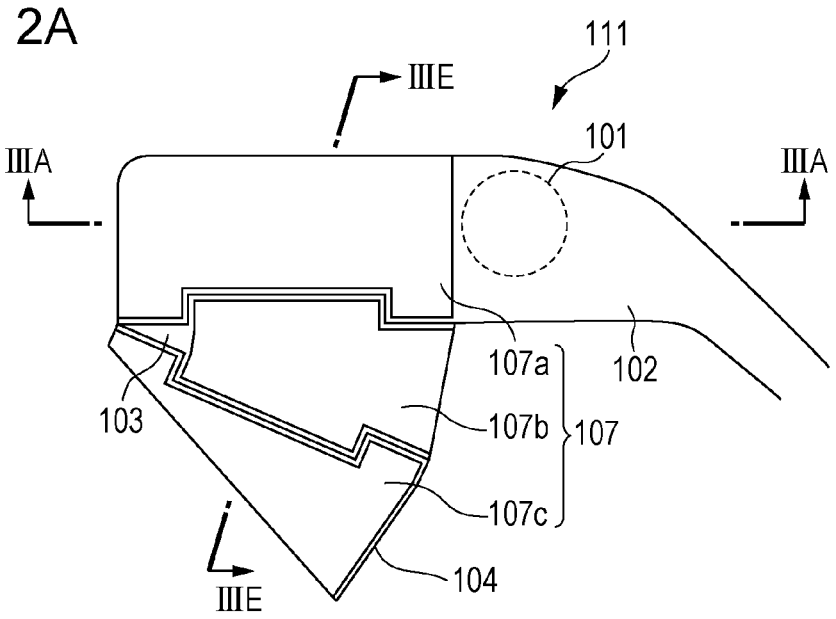
FIG. 2A is a drawing depicting an example of the configuration of a sound transmission section in Embodiment 1.
Figure 2B:
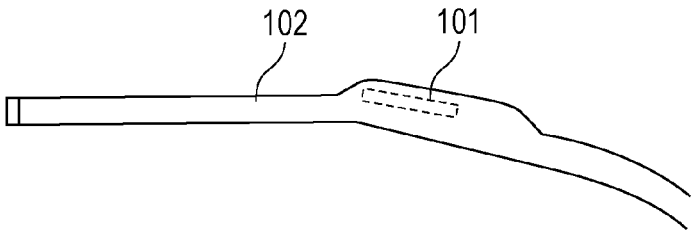
FIG. 2B is a drawing depicting an example of the configuration of the sound transmission section in Embodiment 1.
Figure 2C:
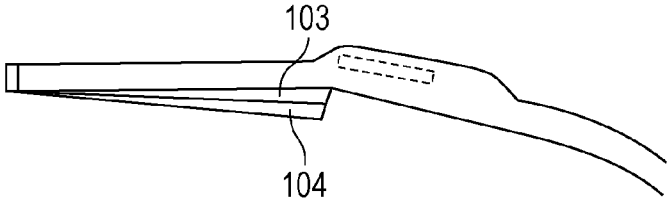
FIG. 2C is a drawing depicting an example of the configuration of the sound transmission section in Embodiment 1.

FIGS. 2A to 2C are drawings depicting an example of the configuration of the sound transmission section 111 in Embodiment 1.

FIG. 2A is a side view in which the sound transmission section 111 of the sound presentation device 100 is seen from the head 1 side when mounted. FIG. 2B is an upper side view of the sound transmission section 111 depicted in FIG. 2A, and FIG. 2C is an upper side view of the sound transmission section 111 depicted in FIG. 2A when casings 103 and 104 are bent toward the body.

As depicted in FIGS. 2A to 2C, the sound transmission section 111 is integrally connected to the arm 110 and is provided with: a casing 102 having an exciter 101 provided therein; the casing 103 connected to the casing 102 by a hinge structure; and the casing 104 connected to the casing 103 by the hinge structure.

Figure 3A:
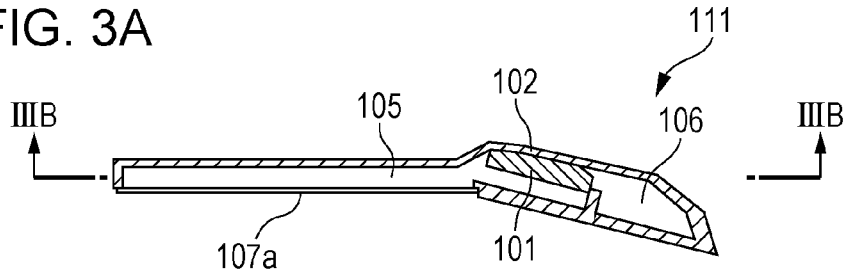
FIG. 3A is a IIIA-IIIA cross-sectional view of the sound transmission section depicted in FIG. 2A.
Figure 3B:
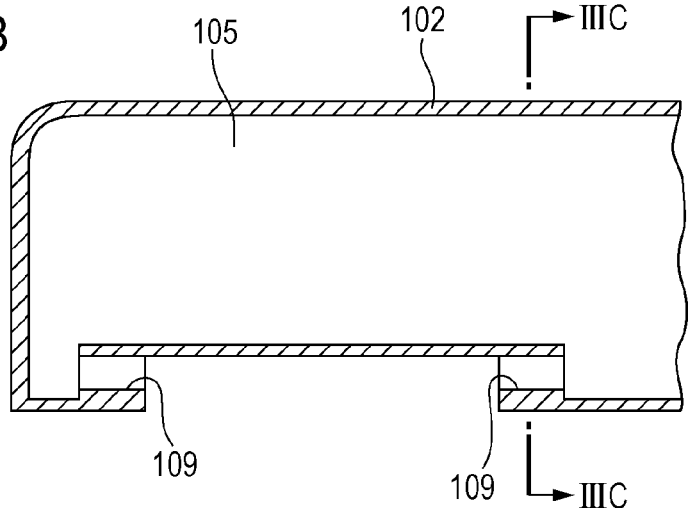
FIG. 3B is a IIIB-IIIB cross-sectional view of the sound transmission section depicted in FIG. 3A.

FIGS. 3A and 3B are cross-sectional views of the sound transmission section 111 in Embodiment 1. Specifically, FIG. 3A is a IIIA-IIIA cross-sectional view of the sound transmission section 111 depicted in FIG. 2A. FIG. 3B is a IIIB-IIIB cross-sectional view of the sound transmission section 111 depicted in FIG. 3A. More specifically, FIG. 3B is a IIIB-IIIB cross-sectional view of the casing 102 in the sound transmission section 111 depicted in FIG. 3A.

Figure 3C:
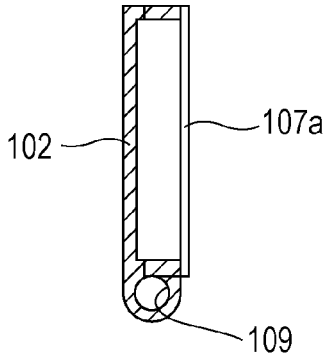
FIG. 3C is a IIIC-IIIC cross-sectional view of the sound transmission section depicted in FIG. 3B.
Figure 3D:
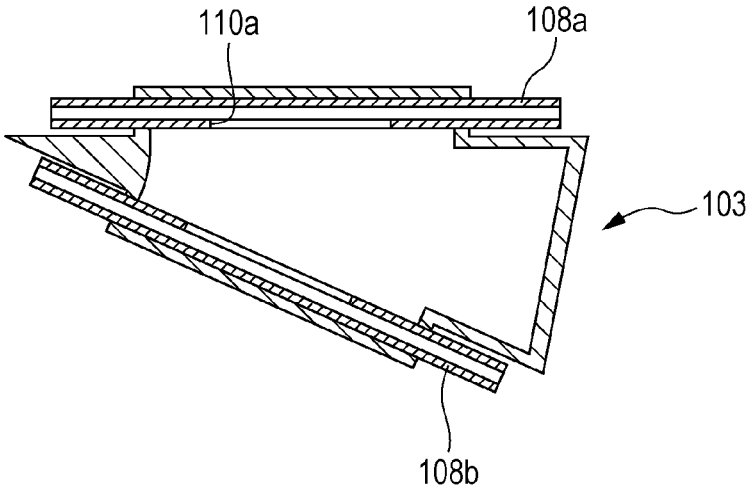
FIG. 3D is a drawing depicting an example of the configuration of a casing.

FIG. 3C is a IIIC-IIIC cross-sectional view of the casing 102 depicted in FIG. 3B. FIG. 3D is a drawing depicting an example of the configuration of the casing 103 in the sound transmission section 111 depicted in FIG. 3A. Specifically, FIG. 3D depicts a cross section of the casing 103, and this cross section is parallel with the IIIB-IIIB cross section depicted in FIG. 3A.

Figure 3E:
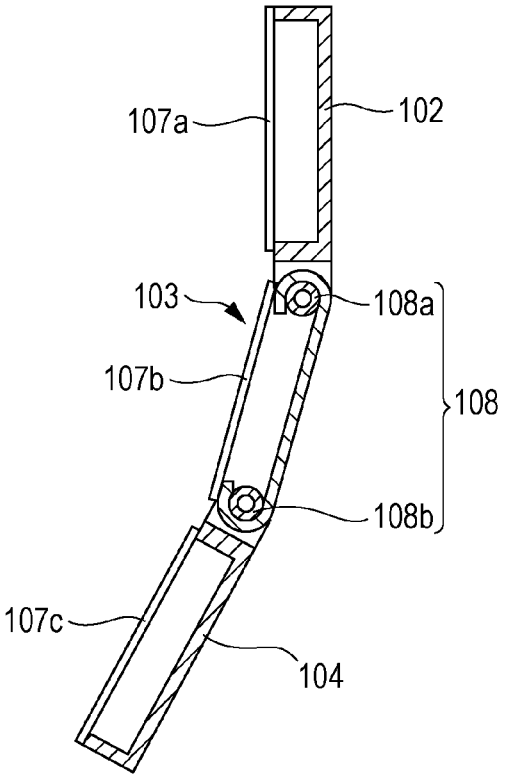
FIG. 3E is a IIIE-IIIE cross-sectional view of the sound transmission section depicted in FIG. 2A.

FIG. 3E is a IIIE-IIIE cross-sectional view of the sound transmission section 111 depicted in FIG. 2A.

As depicted in FIG. 3A, the casing 102 includes the aforementioned exciter 101, a front empty chamber 105, a rear empty chamber 106, and a vibration plate 107*a*. It is preferable that the flexural rigidity in an arbitrary direction parallel with the surface of the vibration plate 107*a* that makes contact with the body be a lower value than the flexural rigidity of, within the wall surface forming the casing 102, the section that has the lowest flexural rigidity in the direction parallel with the inner wall.

The exciter 101 is installed in such a way that a space inside the casing 102 is divided into the front empty chamber 105 and the rear empty chamber 106, which are acoustically isolated. The exciter 101 is also referred to as an electroacoustic transducer and receives an electrical signal and vibrates. An acoustic signal (or a sound wave) is produced by vibration of the exciter 101. The exciter 101 is not particularly restricted as long as the exciter 101 converts an electrical signal into an acoustic signal.

The front empty chamber 105 is preferably a narrow space such that the sound transmission section 111 has a shape that follows the head 1 of the user, and preferably has a thickness with which the transmission of sound is not obstructed due to a resistance component of the inner wall; a thickness of 0.5 mm to 2 mm may be selected, for example. Furthermore, the volume of the front empty chamber 105 may be set to be small within the scope of the aforementioned preferable specification in order to increase the high-band reproduction limit frequency of the sound transmission section 111.

The rear empty chamber 106 is provided in order to prevent sound waves that are produced on the opposite side to the front empty chamber 105 from among the sound waves produced by the vibration of the exciter 101 from leaking outside of the sound presentation device 100 and being radiated around the head, and is preferably linked with a space inside the arm 110. Furthermore, the casing 102 that forms the wall surface of the rear empty chamber 106 is acoustically isolated from the outside of the sound presentation device 100. For example, the section of the casing 102 that forms the wall surface of the rear empty chamber 106 may have a thickness of a degree with which vibration does not occur or it is considered that vibration does not occur due to changes in the pressure in the rear empty chamber 106 produced by the vibration of the exciter 101.

Thus, sound waves produced by the vibration of the exciter 101 do not pass through the front empty chamber 105 (or through the rear empty chamber 106) and are prevented from leaking outside of the sound presentation device 100 and being radiated around the head.

In other words, sound waves produced by the vibration of the exciter 101 solely cause a vibration plate 107 to vibrate via the front empty chamber 105.

Thus, the vibration plate 107 causes the vibration of the exciter 101 to be propagated to the human body via the front empty chamber 105.

The vibration of the vibration plate 107 is propagated to the human body from the location at which the vibration plate 107 makes contact with the human body. The vibration propagated to the human body transmits sound to the user by bone conduction.

Furthermore, it is also feasible for sound to be transmitted to the user by the vibration propagated to the human body being transmitted to the external auditory canal (earhole) and being radiated as sound to the space within the external auditory canal (earhole) and then being transmitted to the eardrum. The transmission of sound such as this is referred to as air conduction.

It is therefore feasible for the transmission of sound to the user based on vibration propagated to the human body to be transmission by only bone conduction or transmission by bone conduction and air conduction.

Furthermore, if the wall surface of the front empty chamber 105 of the casing 102 and the wall surface of the rear empty chamber 106 are formed in a uniform manner, vibration does not occur or it is considered that vibration does not occur due to changes in the pressure in the front empty chamber 105 produced by the vibration of the exciter 101, also with regard to the section of the casing 102 that forms the wall surface of the front empty chamber 105.

Furthermore, although it is desirable that the rear empty chamber 106 be hermetically sealed, the same action is obtained if a sound absorbing material, which is not depicted, is arranged in an open region when the rear empty chamber 106 is not hermetically sealed.

The vibration plate 107*a* is installed in an opening in the front empty chamber 105 side of the casing 102 and is fixed at the peripheral edges of the opening. In order to make contact with the human body when mounted, it is desirable that the vibration plate 107*a* be configured of a material having a rigidity with which it is possible for the vibration plate 107*a* to be in close contact with the human body and for the entirety of the vibration surface to vibrate at the same phase. Specifically, it is desirable that the rigidity of the vibration plate 107*a* be lower than the lowest value of a rigidity value range with which a gap is produced between the vibration plate 107*a* and the human body, and be higher than the highest value of a rigidity value range with which displacement that occurs when the vibration surface vibrates has positive and negative values. For example, the vibration plate 107*a* may be configured of a resin material such as ABS, a polyimide, polyetherimide, a paper material, a fibrous material, a metal material such as aluminum, or a laminated material or a composite material thereof. It should be noted that the vibration plate 107 is similarly installed also in the casing 103 and the casing 104, and is depicted as the vibration plate 107*b* and the vibration plate 107*c* in FIG. 3E.

As depicted in FIGS. 3B and 3C, holes 109 for connecting with cylindrical bodies 108 (a cylindrical body 108*a* and a cylindrical body 108*b*) described later on are included in the casing 102.

As depicted in FIG. 3D, the cylindrical body 108*a* and the cylindrical body 108*b* are included in the casing 103. As depicted in FIG. 2A, the casing 102 and the casing 103 engage at recessed and protruding sections thereof. At these engagement points, the cylindrical body 108*a* of the casing 103 is inserted into the holes 109 of the casing 102 to thereby be flexibly connected. The cylindrical body 108*a* is a hollow member that has an opening 110*a*. The opening 110*a* of the cylindrical body 108*a* is connected to a space inside the casing 103. The casing 103 and the casing 104 are also similarly flexibly connected by the cylindrical body 108*b*, and spaces inside thereof are connected via a hollow section of the cylindrical body 108*b*.

As depicted in FIG. 3E, the spaces inside each of the casing 102, the casing 103, and the casing 104 are linked by the holes 109 and the cylindrical bodies 108*a* and 108*b* and the like.

The operation of the sound presentation device 100 in the present embodiment will be briefly described.

An external sound signal is received by a wireless communication unit of the sound presentation device 100 that is not depicted, is amplified by a voltage amplification unit that is not depicted, and is input to the exciter 101. The exciter 101 vibrates according to the change in voltage of the external sound signal, the pressure in the space inside the casing 102 in which the exciter 101 is positioned changes, and sound waves are thereby produced.

At such time, because the front empty chamber 105 of the casing 102 and the space inside the casing 103 are linked via the hollow section of the cylindrical body 108*a* connected to the holes 109, these spaces are substantially integrated and expand and contract according to the amount of vibration of the exciter 101, and the vibration plates 107*a* and 107*b* are made to vibrate. The space inside the casing 104 is also similarly linked with the space inside the casing 103 via a cylindrical body 108, and therefore the vibration plate 107*c* also vibrates according to the amount of vibration of the exciter 101.

The bone conduction headphone device described in Japanese Unexamined Patent Application Publication No. 2011-130334 is a configuration in which the main vibration output unit and the auxiliary vibration output unit directly vibrate the head, and therefore the vibration area is limited and it is necessary for the main vibration output unit to be firmly pressed against the head in order to transmit by bone conduction a volume that is sufficient to hear sound, which results in user discomfort.

In this regard, according to the sound presentation device 100 in Embodiment 1, the exciter 101 is a configuration that causes the vibration plate 107 to vibrate via the front empty chamber 105, and therefore it is possible to obtain a large area for the vibration plate 107 and thereby reduce the pressing force required to obtain a volume that is subjectively the same. Therefore, compared with the bone conduction headphone device described in Japanese Unexamined Patent Application Publication No. 2011-130334, it becomes possible to reduce user discomfort caused by pressing against the head.

Furthermore, the exciter 101 is a configuration that drives the vibration plate 107*a*, the vibration plate 107*b*, and the vibration plate 107*c* via the front empty chamber 105, and therefore it is not necessary for the exciter 101 to be arranged in a direction perpendicular to the center of the vibration plate 107. Consequently, it is possible to design the shape of the vibration plate 107 and the shapes of the casings in accordance with requirements for the wearing feeling and external appearance without being limited by the position of the exciter 101.

Furthermore, the vibration plate 107*a*, the vibration plate 107*b*, and the vibration plate 107*c* are integrated and vibrate according to the amount of vibration of the exciter 101, and therefore vibrate as one vibration plate 107. Thus, the vibration plate 107 of the sound presentation device 100 overall have a substantially concave shape (substantially bent shape) or a concave shape (bent shape) with respect to the body, and therefore can make contact with the skin along the convex shape of the head, and the risk of separation from the skin can be reduced even when the area is large.

Furthermore, the flexural rigidity of the vibration plate 107 is lower than the flexural rigidity of the casings 102, 103, and 104. In other words, the flexural rigidity of the wall surfaces of the casings 102, 103, and 104 is higher than the flexural rigidity of the vibration plate 107. Therefore, it is possible for the members that vibrate due to changes in the pressure in the spaces inside the front empty chamber 105, the casing 103, and the casing 104 to be limited to only the vibration plate 107. Consequently, it is possible to suppress the leakage of sound to outside of the head caused by excessive vibration of the casings 102, the casing 103, and the casing 104 and suppress energy consumption that does not contribute to hearing sound.

As indicated above, according to the sound presentation device 100 in the present embodiment, the body surface is vibrated by a vibration plate having a substantially bent shape (or a bent shape) that follows the shape of the head, and therefore it is possible to increase the vibration area compared with conventional bone conduction headphones. Therefore, it is possible to reduce the pressure on the body surface when the same vibration force is transmitted to the middle ear compared with conventional bone conduction headphones, and it is possible to reduce user discomfort caused by pressing by a vibration element while also ensuring a volume.

Furthermore, rather than the body surface or the vibration plate 107*a* being directly vibrated by the exciter 101, the vibration plate 107*a* is vibrated via the front empty chamber 105 and the body surface is vibrated via the vibration plate 107*a*. By causing the vibration plate 107 to vibrate once via the front empty chamber 105 in this way, the vibration plate 107 having a large area can be made to vibrate in a stable manner by a small force.

Furthermore, in the sound presentation device 100 in the present embodiment, the space inside the casing 102 is separated into two empty chambers by the exciter 101, namely the front empty chamber 105 and the rear empty chamber 106. The front empty chamber 105 causes the vibration of the exciter 101 to be propagated to the vibration plate 107, and the rear empty chamber 106 suppresses sound waves produced at the opposite side to the front empty chamber 105 by the vibration of the exciter 101 from being radiated to outside the sound presentation device 100.

Figure 4A:
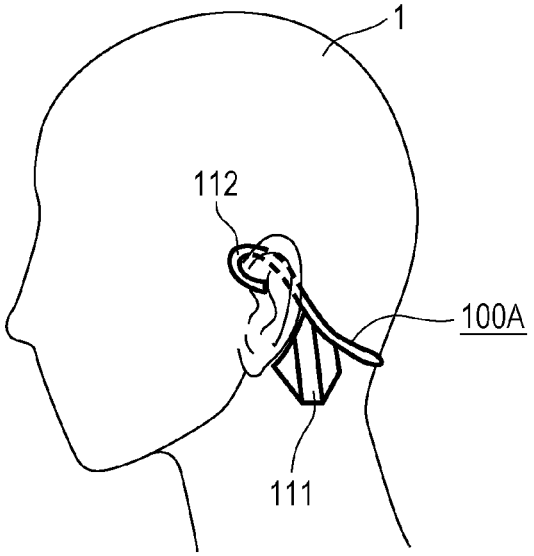
FIG. 4A is a drawing depicting an example of a state in which a sound presentation device in a modified example of Embodiment 1 is worn.
Figure 4B:
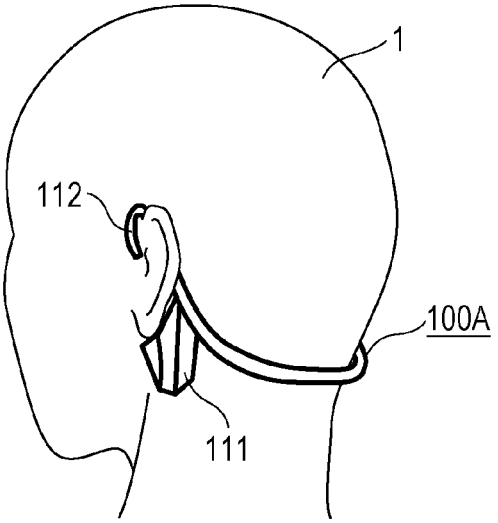
FIG. 4B is a drawing depicting an example of a state in which the sound presentation device in the modified example of Embodiment 1 is worn.

Furthermore, in Embodiment 1, the sound transmission section 111 is arranged so as to make contact in front of the ear as depicted in FIGS. 1A and 1B; however, the position of the sound transmission section 111 is not restricted thereto. For example, the sound transmission section 111 may be arranged so as to make contact with a lower section behind the ear as indicated by a sound presentation device 100A depicted in FIGS. 4A and 4B. In this regard, FIGS. 4A and 4B are drawings depicting an example of a state in which the sound presentation device 100A in a modified example of Embodiment 1 is worn. FIG. 4A is a drawing in which the head 1 of the person on which the sound presentation device 100A is mounted is viewed from the side, and FIG. 4B is a drawing in which the head 1 of the person on which the sound presentation device 100A is mounted is viewed from behind. According to the present configuration, the sound transmission section 111 is not exposed to the face section, and therefore any effect on appearance such as the clothing and hairstyle of the user can be minimized.

It should be noted that, in the present configuration, it is desirable that the sound presentation device 100A be further provided with a holding unit 112 for holding the sound transmission section 111 at a lower section behind the ear. The holding unit 112 may have a hook shape that hooks onto the ear as depicted in FIGS. 4A and 4B, and may have a necklace shape that hangs around the neck or a headband shape that encloses the head from above.

Furthermore, the vibration plates 107*a* to 107*c* are configurations with which the all of the surfaces thereof make contact with the skin; however, the skin-side surface shape is not restricted thereto. For example, in order to alleviate discomfort due to stuffiness caused by stuffy heat, sweat, or sebum, the surfaces of the vibration plates may be provided with recesses and protrusions or may be provided with one or more holes as long as the air inside the front empty chamber and outside air are not connected. In addition, fabric may be stretched across one or both surfaces of the vibration plates, and fabric having a water-absorbing or antibacterial function or the like may be used for the skin-side surface, and fabric having a water-repelling function or the like may be used for the front empty chamber-side surface, for example.

Furthermore, an element such as a sensor may be provided on the vibration plates 107*a* to 107*c* and the casings 102 to 104 as long as the function to transmit vibration to the human body is not impaired, and any of a contact sensor, a temperature sensor, a pulse sensor, or an acoustic sensor may be used, for example. Furthermore, some or all of the vibration plates 107*a* to 107*c* may also be provided with a sensor-element constituent mechanism.

In the present embodiment, an example has been given in which three casings are connected such as with the casings 102 to 104; however, it should be noted that the present disclosure is not restricted thereto. Four or more casings may be similarly connected, or only one or two casings may be used.

Furthermore, the arm 110 is not an essential configuration in the present embodiment. For example, a configuration that does not have the arm 110 is also feasible if members that are adhesive with respect to skin are adopted for some of the configurations (the vibration plate 107 or the peripheral edge sections of the vibration plate 107 of the casings 102 to 104, for example) within the sound transmission section 111.

(Embodiment 2)

Hereinafter, a sound presentation device in Embodiment 2 will be described with reference to the drawings. It should be noted that descriptions that are the same as those in Embodiment 1 are omitted in parts of the present embodiment. Furthermore, it is also possible to combine with the technology described in Embodiment 1.

The state in which the sound presentation device in Embodiment 2 is worn is the same as in Embodiment 1 and therefore a depiction thereof is omitted. The differences with Embodiment 1 are that the casings that form the sound transmission section are a single body rather than a plurality of connected bodies, and that the bent shape is fixed. Furthermore, the casings are provided with spacers therein in Embodiment 2.

Figure 5A:
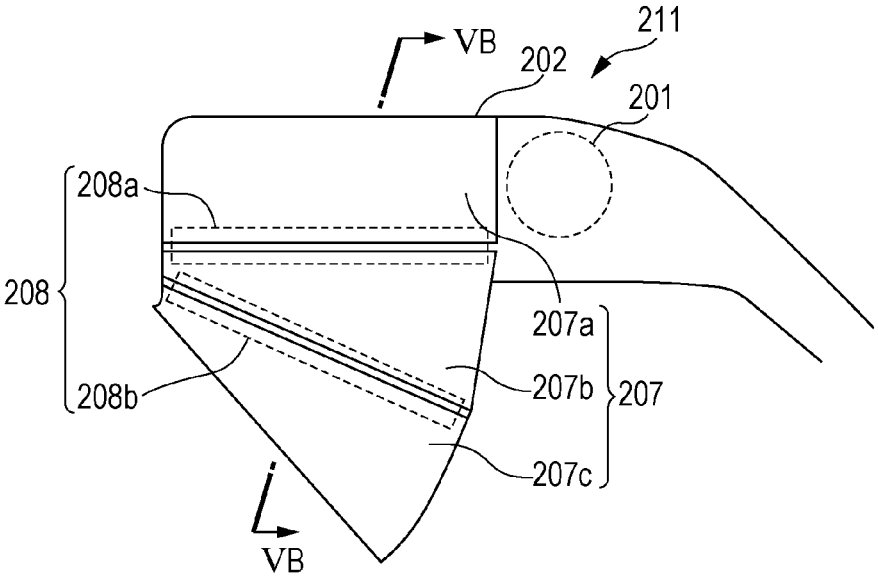
FIG. 5A is a drawing depicting an example of the configuration of a sound transmission section of a sound presentation device in Embodiment 2.
Figure 5B:
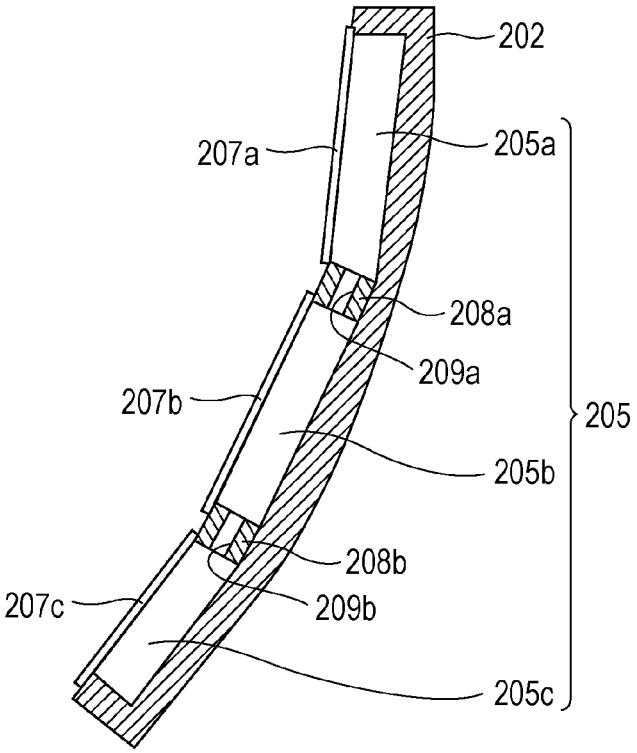
FIG. 5B is a VB-VB cross-sectional view of the sound transmission section depicted in FIG. 5A.
Figure 6:
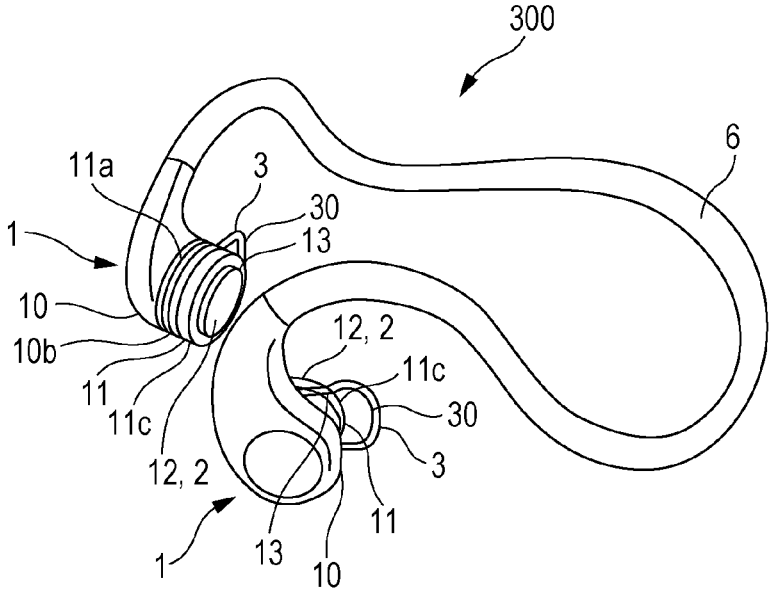
FIG. 6 PRIOR ART
FIG. 6 is a drawing depicting a bone conduction headphone device described in Japanese Unexamined Patent Application Publication No. 2011-130334.

FIGS. 5A and 5B are drawings depicting an example of the configuration of a sound transmission section 211 of the sound presentation device in Embodiment 2. FIG. 5A is a side view in which the sound transmission section 211 of the sound presentation device is seen from a head 1 when mounted. FIG. 5B is a VB-VB cross-sectional view of the sound transmission section 211 depicted in FIG. 5A.

A casing 202 includes an exciter 201, a front empty chamber, a rear empty chamber that is not depicted, a vibration plate 207*a*, a vibration plate 207*b*, a vibration plate 207*c*, a spacer 208*a*, and a spacer 208*b*. As depicted in FIG. 5B, the casing 202 overall has a curved shape (or a bent shape) that follows the shape of the head 1.

The spacer 208*a* and the spacer 208*b* are provided inside the casing 202 and are fixed to the inner wall of the casing 202. Furthermore, a hole 209*a* and a hole 209*b* are arranged in the spacer 208*a* and the spacer 208*b*, respectively.

The spacer 208*a* and the spacer 208*b* divide the front empty chamber of the casing 202 into a front empty chamber 205*a*, a front empty chamber 205*b*, and a front empty chamber 205*c*.

The hole 209*a* links the front empty chamber 205*a* and the front empty chamber 205*b*, and the hole 209*b* links the front empty chamber 205*b* and the front empty chamber 205*c*. The vibration plates 207*a* to 207*c* are installed in openings in the front empty chamber 205 side of the casing 202 and are fixed at the peripheral edges of the openings. Furthermore, the vibration plates 207*a* to 207*c* are each supported by the spacer 208*a* or the spacer 208*b*.

The sections between the vibration plates 207*a* to 207*c* and the casing 202, spacer 208*a*, and spacer 208*b* are sealed without any gaps. It should be noted that the vibration plates 207*a* to 207*c* may be formed as a single body. In other words, a vibration plate 207 that is a single plate may be used and a portion of the vibration plate 207 may be arranged so as to make contact with the casing 202, the spacer 208*a*, and the spacer 208*b*.

It is desirable that the rigidity of the spacers 208*a* and 208*b* be lower nearer the contact surfaces with the vibration plates 207*a* to 207*c* and higher nearer the surfaces on the opposite side to the contact surfaces. The material of the spacers 208*a* and 208*b* may be a polyurethane or the like near the contact surfaces with the vibration plates 207*a* to 207*c*, and may be the same material as the casing 202 in sections other than those near the contact surfaces, for example.

In this way, the same effect as that of Embodiment 1 is also obtained in Embodiment 2 for elements that are common to Embodiment 1. In addition, according to the sound presentation device in Embodiment 2, the spacers 208*a* and 208*b* deform following the vibration of the vibration plates 207*a* to 207*c*, and therefore the vibration plates 207*a* to 207*c* vibrate in the same way as a single vibration plate without the movement being hindered by the spacers 208*a* and 208*b*, and the vibration area can be further increased as a result.

Furthermore, the spacers 208*a* and 208*b* do not deform in sections other than those near the contact surfaces with the vibration plates 207*a* to 207*c*, and therefore it is possible to avoid the vibration plates 207*a* to 207*c* making contact with the inner wall of the casing 202 and to avoid the volume of the front empty chamber 205 changing due to the contact condition with a human body and the frequency characteristics of heard sound changing.

The front empty chamber 205 of the casing 202 is divided into three regions (the front empty chamber 205*a*, the front empty chamber 205*b*, and the front empty chamber 205*c*) in the present embodiment; however, it should be noted that the present disclosure is not restricted thereto. The front empty chamber 205 may be divided into four or more regions, or divided into one or two regions. Furthermore, an arm 110 is not an essential configuration in the present embodiment. For example, the arm is not necessary if members that are adhesive with respect to skin are adopted for some of the configurations (the vibration plate 207, for example) within the sound transmission section 211.

Heretofore, a description of a sound presentation device according to one or more aspects of the present disclosure has been given based on the embodiments; however, the present disclosure is not restricted to these embodiments. Modes in which various modifications conceived by a person skilled in the art have been implemented in the present embodiments, and modes constructed by combining the constituent elements in different embodiments may also be included within the scope of one or more aspects of the present disclosure provided they do not depart from the purpose of the present disclosure.

It is possible for the sound presentation device according to the present disclosure to be provided as a wearable sound presentation device that achieves both comfort when worn and a volume that can be heard, and may be used in headphones, a wearable information terminal, a navigation device, a hearing aid, and a headset or the like.

What is claimed is:

1. A sound presentation device comprising:

a casing;

an electroacoustic transducer that is installed within a space inside the casing, the electroacoustic transducer dividing the space inside the casing into a first empty chamber and a second empty chamber that are acoustically isolated from each other, and that receives an electrical signal and vibrates; and a vibration plate that makes contact with a body surface of a human body when the sound presentation device is mounted on the body surface, and causes vibration of the electroacoustic transducer to be propagated to the human body via the first empty chamber, wherein the second empty chamber suppresses sound waves produced by the vibration of the electroacoustic transducer from being emitted to outside of the sound presentation device via the second empty chamber.

2. A sound presentation device comprising:

a casing;

an electroacoustic transducer that is installed in such a way that a space inside the casing is divided into a first empty chamber and a second empty chamber that are acoustically isolated from each other, and that receives an electrical signal and vibrates; and a vibration plate that makes contact with a body surface of a human body when the sound presentation device is mounted on the body surface, and causes vibration of the electroacoustic transducer to be propagated to the human body via the first empty chamber, wherein the second empty chamber suppresses sound waves produced by the vibration of the electroacoustic transducer from being emitted to outside of the sound presentation device via the second empty chamber, the vibration plate includes at least a first vibration plate and a second vibration plate, the first empty chamber includes at least a first region and a second region, the casing includes at least a first casing that forms the first region and a second casing that forms the second region, and the first vibration plate is arranged in the first casing and the second vibration plate is arranged in the second casing.

3. The sound presentation device according to claim 2, wherein the first casing includes a hole, the second casing includes a cylindrical body that is a hollow cylinder, and the first region and the second region are linked due to the cylindrical body being inserted into the hole.

4. The sound presentation device according to claim 1, wherein the second empty chamber is hermetically sealed by the casing to suppress the sound waves from being emitted to outside of the sound presentation device.

5. The sound presentation device according to claim 1, wherein a sound absorbing material is arranged in part of the second empty chamber to suppress the sound waves from being emitted to outside of the sound presentation device.

6. A sound presentation device comprising:

a casing;

an electroacoustic transducer that is installed in such a way that a space inside the casing is divided into a first empty chamber and a second empty chamber that are acoustically isolated from each other, and that receives an electrical signal and vibrates;

a vibration plate that makes contact with a body surface of a human body when the sound presentation device is mounted on the body surface, and causes vibration of the electroacoustic transducer to be propagated to the human body via the first empty chamber; and a spacer that is disposed inside the casing and makes contact with both the vibration plate and a casing inner wall, wherein the second empty chamber suppresses sound waves produced by the vibration of the electroacoustic transducer from being emitted to outside of the sound presentation device via the second empty chamber.

7. The sound presentation device according to claim 6, wherein the spacer divides the first empty chamber into a plurality of regions, and the plurality of regions are linked due to a hole provided in the spacer.

8. The sound presentation device according to claim 6, wherein a flexural rigidity of a portion of the casing that covers the first empty chamber is greater than a flexural rigidity of the vibration plate, and the vibration plate has a bent shape.

9. The sound presentation device according to claim 1, wherein the casing that forms a wall surface of the second empty chamber suppresses the sound waves produced by the vibration of the electroacoustic transducer from being emitted to outside of the sound presentation device.

10. The sound presentation device according to claim 1, wherein the first empty chamber is enclosed by the casing, the vibration plate and the electroacoustic transducer, and the second empty chamber is provided at a rear side of the first empty chamber and enclosed by the casing and the electroacoustic transducer.

11. The sound presentation device according to claim 1, wherein the electroacoustic transducer is contained within the space of the casing.

12. The sound presentation device according to claim 1, wherein the first empty chamber defines a free end of the casing, the vibration plate is located at the free end of the casing, and the electroacoustic transducer is spaced from the vibration plate in an elongation direction of the casing.

* * * * *